US010201473B2

(12) United States Patent
Shankland et al.

(10) Patent No.: US 10,201,473 B2
(45) Date of Patent: Feb. 12, 2019

(54) RESPIRATORY TREATMENT DEVICE

(71) Applicants: Sharon Ann Shankland, Marysville, WA (US); Dianna Lynn Shankland, Marysville, WA (US)

(72) Inventors: Sharon Ann Shankland, Marysville, WA (US); Dianna Lynn Shankland, Marysville, WA (US)

( * ) Notice: Subject to any disclaimer, the term of this patent is extended or adjusted under 35 U.S.C. 154(b) by 896 days.

(21) Appl. No.: 14/622,493

(22) Filed: Feb. 13, 2015

(65) Prior Publication Data

US 2015/0231025 A1 Aug. 20, 2015

Related U.S. Application Data

(60) Provisional application No. 61/939,917, filed on Feb. 14, 2014.

(51) Int. Cl.
*A61H 23/06* (2006.01)
*A61H 23/00* (2006.01)

(52) U.S. Cl.
CPC ..... *A61H 23/06* (2013.01); *A61H 23/004* (2013.01); *A61H 23/006* (2013.01); *A61H 2201/0153* (2013.01); *A61H 2201/0157* (2013.01); *A61H 2201/1253* (2013.01); *A61H 2205/08* (2013.01)

(58) Field of Classification Search
CPC ..... F16B 21/02; F16B 5/008; F16B 5/0092; A61H 23/00; A61H 2023/002; A61H 23/004; A61H 23/006; A61H 23/02; A61H 23/0254; A61H 23/04; A61H 23/06; A61H 31/00; A61H 2031/001; A61H 2201/0107; A61H 2201/013; A61H 2201/0153; A61H 2201/0157; A61H 2201/0161
See application file for complete search history.

(56) References Cited

U.S. PATENT DOCUMENTS 998,328 A * 7/1911 Czinjak ..... A61H 23/06 15/143.1
1,050,836 A * 1/1913 Jones ..... A61B 17/12 601/107
1,267,554 A * 5/1918 Karatsu ..... A61B 9/00 600/553
1,478,388 A * 12/1923 Gray ..... A61H 23/06 15/143.1
1,603,131 A * 10/1926 Mabie ..... A61H 23/06 601/107
1,649,089 A * 11/1927 Volckening ..... A61H 23/06 15/118
1,973,768 A * 9/1934 Knapp ..... A61H 23/06 15/144.3
2,054,849 A 9/1936 Briggs
(Continued)

*Primary Examiner* — Rachel T Sippel
*Assistant Examiner* — Tu Vo
(74) *Attorney, Agent, or Firm* — Knobbe, Martens, Olson & Bear, LLP

(57) ABSTRACT

A respiratory treatment device can include a removable cup portion. The cup portion can be removably couple to a weighted head. The weighted head can be connected to a first end of a shaft. A second end of the shaft can be connected to a handle. A center of gravity of the device along a length of the device can be modified by increasing or decreasing the weight of the handle and/or of the weighted head. A user of the treatment device can tap a patient with the cup portion of the device. The weighted head can increase deflection in shaft of the device during use.

17 Claims, 10 Drawing Sheets

(56) References Cited

U.S. PATENT DOCUMENTS

| | | | | |
|---|---|---|---|---|
| 2,187,560 | A * | 1/1940 | Reilly | A61H 13/00 401/158 |
| 4,196,722 | A | 4/1980 | Vanderwoude | |
| 4,266,588 | A | 5/1981 | Tudisco | |
| 4,324,261 | A | 4/1982 | Mark et al. | |
| 4,429,688 | A | 2/1984 | Duffy | |
| 4,633,741 | A | 6/1987 | Yang | |
| 4,683,784 | A | 8/1987 | Lamont | |
| 4,745,910 | A | 5/1988 | Day et al. | |
| 5,568,669 | A * | 10/1996 | Godown | A45D 34/04 132/320 |
| 2005/0079010 | A1 * | 4/2005 | Droppleman | F16B 21/04 403/348 |
| 2008/0086065 | A1 * | 4/2008 | Holm | A61H 23/00 601/107 |
| 2008/0125682 | A1 * | 5/2008 | Bonneyrat | A61H 7/00 601/112 |
| 2012/0130291 | A1 | 5/2012 | Dillingham et al. | |

* cited by examiner

RESPIRATORY TREATMENT DEVICE

CROSS-REFERENCE TO RELATED APPLICATIONS

This application claims a priority benefit under 35 U.S.C. § 119(e) to U.S. Provisional Application No. 61/939,917, filed Feb. 14, 2014, entitled "RESPIRATORY CUPPING ARM," which is hereby incorporated by reference in its entirety.

Any and all applications for which a foreign or domestic priority claim is identified in the Application Data Sheet as filed with the present application are hereby incorporated by reference under 37 CFR 1.57.

BACKGROUND OF THE INVENTIONS

Technical Field

The present disclosure generally relates to respiratory therapy devices used in the treatment of respiratory diseases.

Description of the Related Art

Various devices and methods are used to perform chest physical therapy. For example, clinicians and others use cupped hands and other devices to apply percussive force on the chest and/or back of a patient. The application of percussive and/or vibrational force on the patient can loosen secretions within the lung, enabling the patient to then cough out the loosened secretions.

SUMMARY OF THE INVENTIONS

A respiratory cupping device can include a shaft. The shaft can have a first end, a second end, a shaft length extending between the first end and the second end, a shaft width measured normal to the shaft length, and a shaft thickness measured perpendicular to the width and normal to the shaft length. The device can include a handle. The handle can include a first end, a second end, a handle length extending between the first end and the second end of the handle, and a handle width measured normal to the handle length. The second end of the handle can be connected to the second end of the shaft. In some embodiments, the device includes a weighted head having a front face and connected to the first end of the shaft. The device can include a cup. The cup can be removably connected to the weighted head and having a back side facing the front face of the weighted head and a front side facing away from the weighted head, the front side having a raised perimeter surrounding a central portion of the cup, the raised perimeter extending further away from the weighted head than the central portion.

In some embodiments, the shaft is constructed from a metal. In some cases, the raised perimeter is constructed from a foam. In some embodiments, the weighted head weighs at least 1.5 ounces. In some cases, the shaft width is constant from the first end of the shaft to the second end of the shaft. In some embodiments, the shaft thickness is constant from the first end of the shaft to the second end of the shaft. In some cases, the cup includes a keyed protrusion extending from the back side of the cup. The weighted head can include a keyed recess sized and shaped to couple with the keyed protrusion to releasably couple the cup to the weighted head. In some embodiments, the cup includes a protrusion extending from the back side of the cup. The protrusion can have a protrusion height and a protrusion width as measured parallel to the back side of the cup, the protrusion width being greater than the protrusion height. In some embodiments, the weighted head includes a recess having an opening with an opening height and an opening width. The opening height can be greater than the protrusion height and the opening width can be greater than the protrusion width. In some embodiments, the recess is configured to receive the protrusion therein. In some cases, the recess has a perimeter greater than a perimeter of the opening of the recess. In some embodiments, the perimeter of the opening of the recess interferes with movement of the of the cup away from the weighted head after the protrusion is inserted into the recess and rotated about an axis of rotation normal to the back side of the cup.

In some embodiments, the handle and the shaft form a monolithic part. In some cases, the handle is constructed from a polymer. In some embodiments, the handle width is at least five times greater than the thickness of the shaft and at least 1.5 times greater than the shaft width. In some embodiments, the weighted head includes a back portion having a first width and height measured parallel to the front face, and a front portion having a second width and height measured parallel to the front face, wherein the second width is greater than the first width and the second height is greater than the first height. In some cases, the raised perimeter of the cup has a third width and height, and wherein the second width is greater than ¾ of the third width and the second height is greater than ¾ of the third height.

According to some variants, a method of performing chest physical therapy can include obtaining a respiratory therapy device. The respiratory device can have a handle. In some embodiments, the respiratory device includes a shaft connected to and extending from the handle, a weighted head connected to an end of the shaft opposite an end of the shaft connected to the handle, and a removable cup coupled to the weighted head. The removable cup can have a center portion and a raised cushioned perimeter surrounding the center portion. The method can include impacting a first patient with the cushioned perimeter. In some embodiments, the method includes removing the removable cup from the weighted head. In some cases, the method includes sterilizing the handle, shaft, and weighted head. In some embodiments, the method includes coupling a second removable cup to the weighted head. In some cases, the method includes impacting a second patient with a cushioned perimeter of the second removable cup.

According to some variants, a chest physical therapy device can include a handle having a first end and a second end. The device can include a shaft having a shaft width, a shaft thickness perpendicular to the shaft width, a first end, and a second end connected to the first end of the handle. In some embodiments, the device includes a weighted head connected to the first end of the shaft. The device can include a removable cup having a convex side removably connected to the weighted head and a concave side facing away from the weighted head. In some embodiments, the first end of the shaft flexes downward at least ¼ inches when the handle is fixed horizontally, the shaft width is oriented horizontally, and the removable cup is removed from the weighted head. In some cases, the first end of the shaft flexes downward approximately ⅜ inches when the handle is fixed horizontally and the shaft width is oriented horizontally. In some embodiments, the first end of the shaft flexes downward approximately 3½ inches when the handle is fixed horizontally, the shaft width is oriented horizontally, the removable cup is removed from the weighted head, and a one pound weight is attached to the weighted head. In some cases, the first end of the shaft flexes downward approximately 4½ inches when the handle is fixed horizontally, the shaft width is oriented horizontally, the removable cup is removed from the weighted head, and a two pound weight is attached to the weighted head.

BRIEF DESCRIPTION OF THE DRAWINGS

Various embodiments are depicted in the accompanying drawings for illustrative purposes, and should in no way be interpreted as limiting the scope of the embodiments. In addition, various features of different disclosed embodiments can be combined to form additional embodiments, which are part of this disclosure.

DETAILED DESCRIPTION OF THE EMBODIMENTS

Embodiments of the inventions will now be described with reference to the accompanying figures, wherein like numerals refer to like elements throughout. Although several embodiments, examples and illustrations are disclosed below, it will be understood by those of ordinary skill in the art that the inventions described herein extends beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

For expository purposes, the term "horizontal" as used herein is defined as a plane parallel to the plane or surface of the floor of the area in which the device being described is used or the method being described is performed, regardless of its orientation. The term "floor" floor can be interchanged with the term "ground." The term "vertical" refers to a direction perpendicular to the horizontal as just defined. Terms such as "above," "below," "bottom," "top," "side," "higher," "lower," "upper," "over," and "under," are defined with respect to the horizontal plane.

Figure 1:
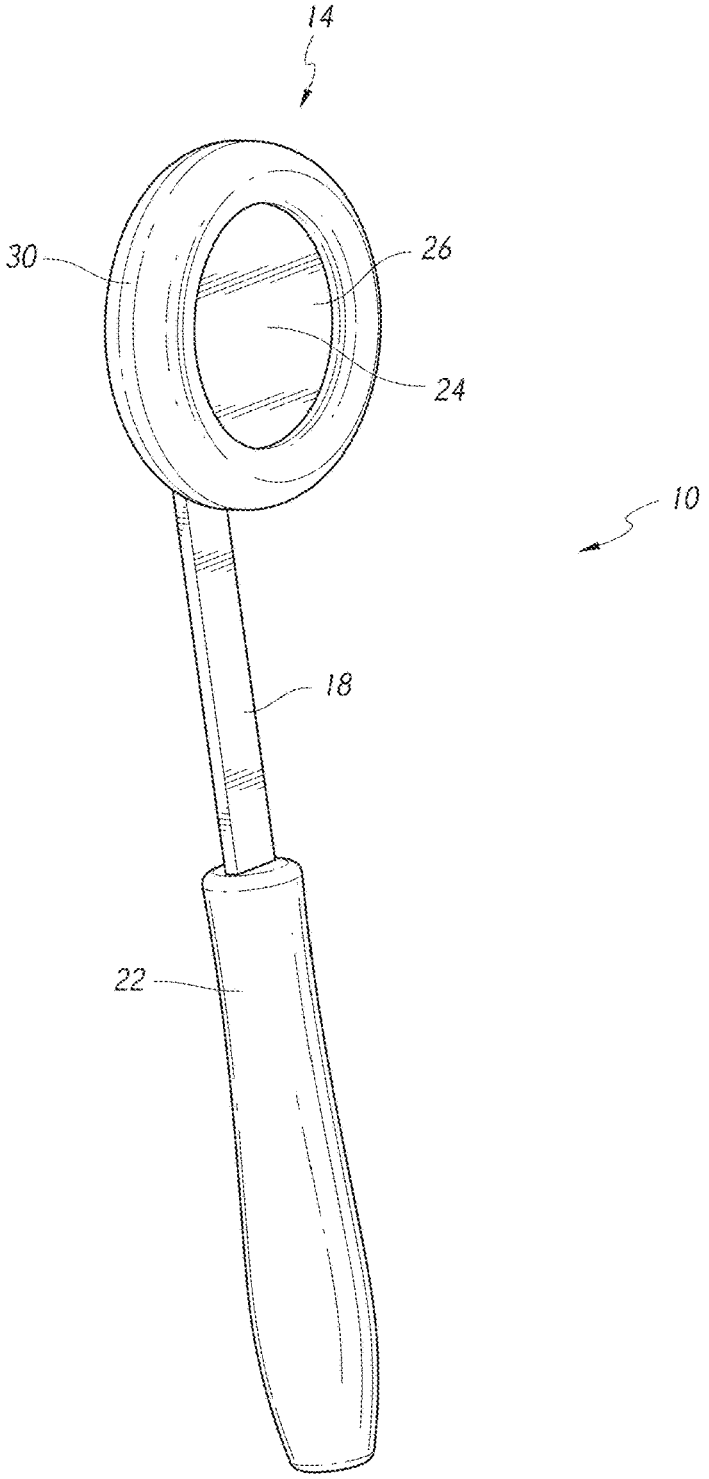
FIG. 1 is a front perspective view of an embodiment of a respiratory treatment device.
Figure 2:
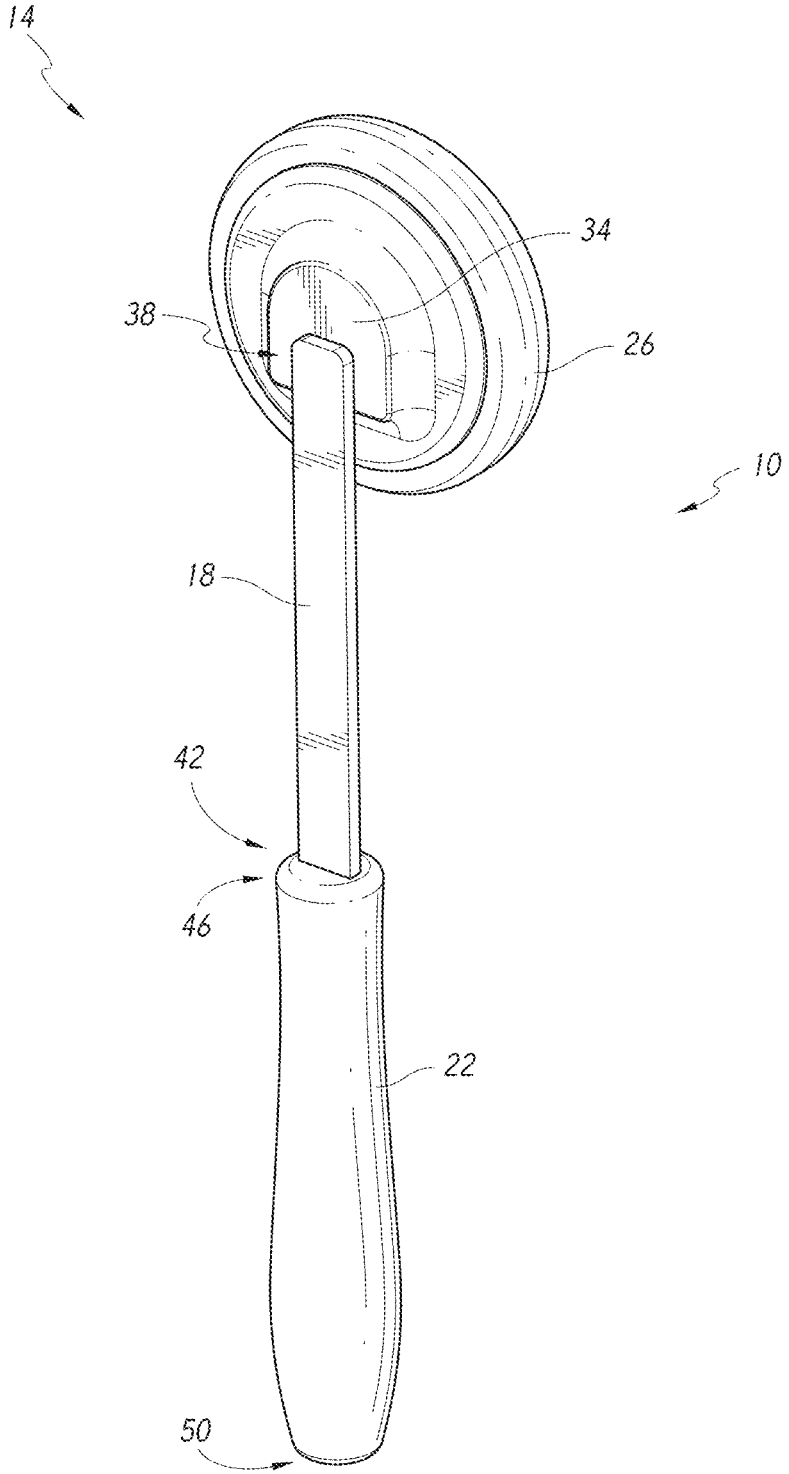
FIG. 2 is a rear perspective view of the respiratory treatment device of FIG. 1.
Figure 3:
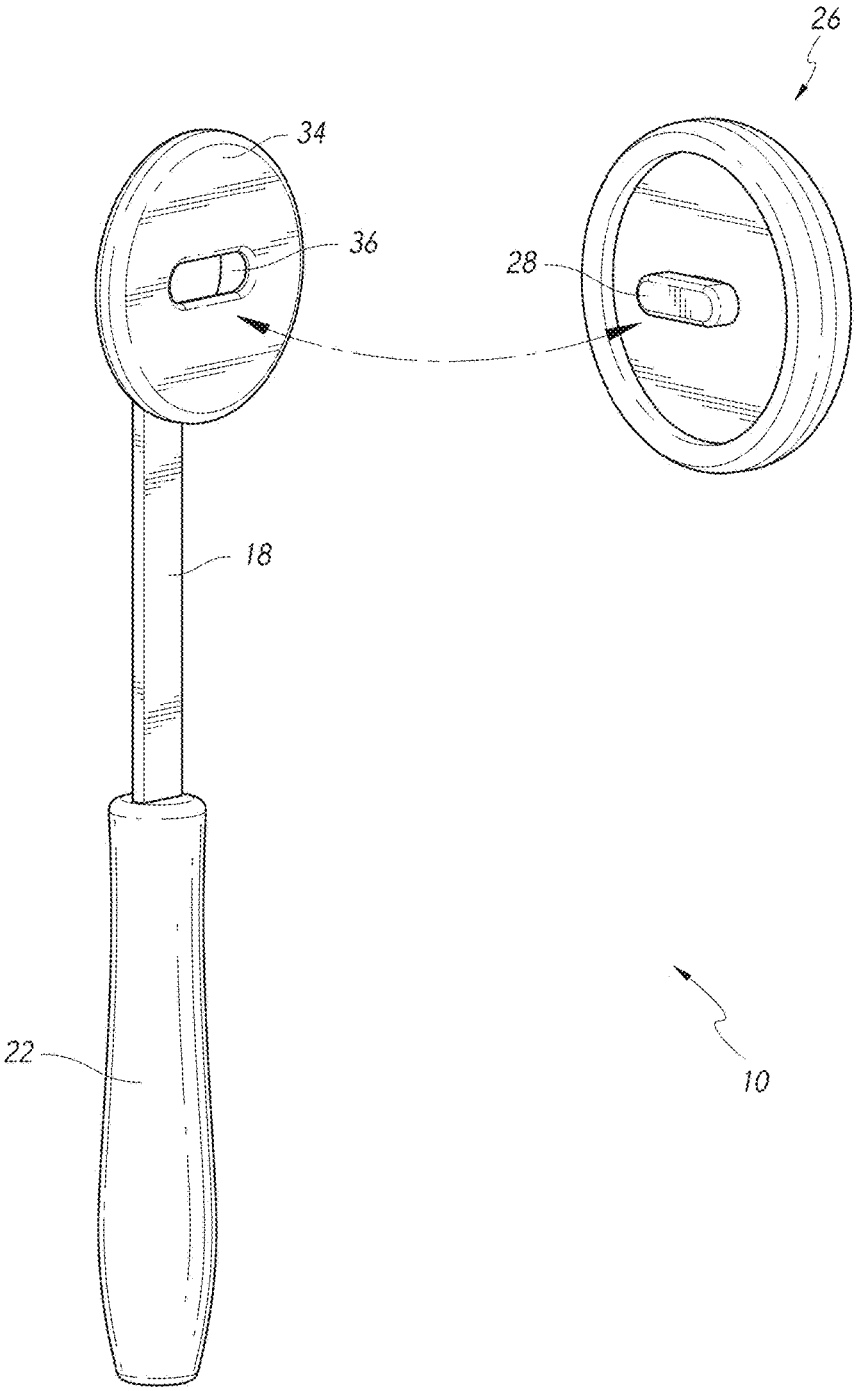
FIG. 3 is a perspective exploded view of the respiratory treatment device of FIG. 1 wherein the removable cup is uncoupled from the head of the device.

As illustrated in FIGS. 1-3, a respiratory treatment device 10 can include an impact portion 14. The impact portion 14 can be sized, shaped, and/or weighted to impact (e.g., tap or strike) a patient during a chest therapy session. The device 10 can include a shaft 18 connected to the impact portion 14. The shaft 18 can extend from the impact portion 14 in a direction substantially parallel (e.g., within ±10° degrees of parallel) to a plane of a front face of the impact portion 14. The shaft 18 can be configured to flex (e.g., bend) forward and backward (e.g., into and out of the page of FIG. 4 and in the directions 76 of FIG. 6) during use of the device 10. In some embodiments, the device 10 includes a handle 22 connected to the shaft 18 on an end of the shaft 18 opposite the impact portion 14. The handle 22 can be configured to remain stiff (e.g., exhibit little or no bending) during use of the device 10.

The impact portion 14 can include a cup 26. The cup 26 can be constructed from a polymer or other flexible, semi-flexible, and/or resilient material. The cup 26 can have a convex back side and a concave front side. As illustrated in FIG. 1, the cup 26 can include a center portion 24 surrounded by a raised rim 30 or lip. The rim 30 can extend from a front face of the cup 26. In some embodiments, the rim 30 is constructed from a foam, sponge, or other soft and/or resilient material. In some cases, the rim 30 is constructed from the same material as the entirety of the cup 26.

As illustrated in FIGS. 2 and 3, the impact portion 14 can include a head 34. The head 34 can be connected to a first end 38 of the shaft 18. In some embodiments, the head 34 is fixedly connected to a first end 38 of the shaft 18, by welding or adhesives or by another method or combination of methods. In some embodiments, the head 34 is removably connected to the first end 38 of the shaft 18 via threading, friction fitting, detent fitting, magnets, and/or via some other mating structures or methods. The head 34 can include a mating structure configured to releasably mate with a mating structure of the cup 26. For example, the head 34 can include a recess 36 sized and shaped to receive a protrusion 28 on a back side of the cup 26. In some cases, the cup 26 is removably coupled to the head 34 via threading, friction fitting, detent fitting, magnets, and/or via some other mating structures or methods. As discussed in more detail below, the recess 36 and protrusion 28 can be keyed to each other to facilitate releasable and secure coupling between the cup 26 and the head 34.

In some embodiments, the head 34 is weighted. For example, the head 34 can be manufactured from a metal, high-density polymer, high-density ceramic, or other high-density material. For example, the head 34 can be constructed from hardened and/or tempered steel having a high density. The head 34 can weigh greater than 1 ounce, greater than 1.5 ounces, greater than 2 ounces, greater than 2.5 ounces, greater than 3 ounces, greater than 3.5 ounces, and/or greater than 4 ounces, depending on the parameters of the desired chest physical therapy. For example, for adults or large children/adolescents, a heavier head 34 may be used to facilitate thorough loosening of secretions within the lungs. On the other hand, a lighter head 34 can be used for infants and/or children to reduce the likelihood of injury during chest physical therapy.

Figure 12:
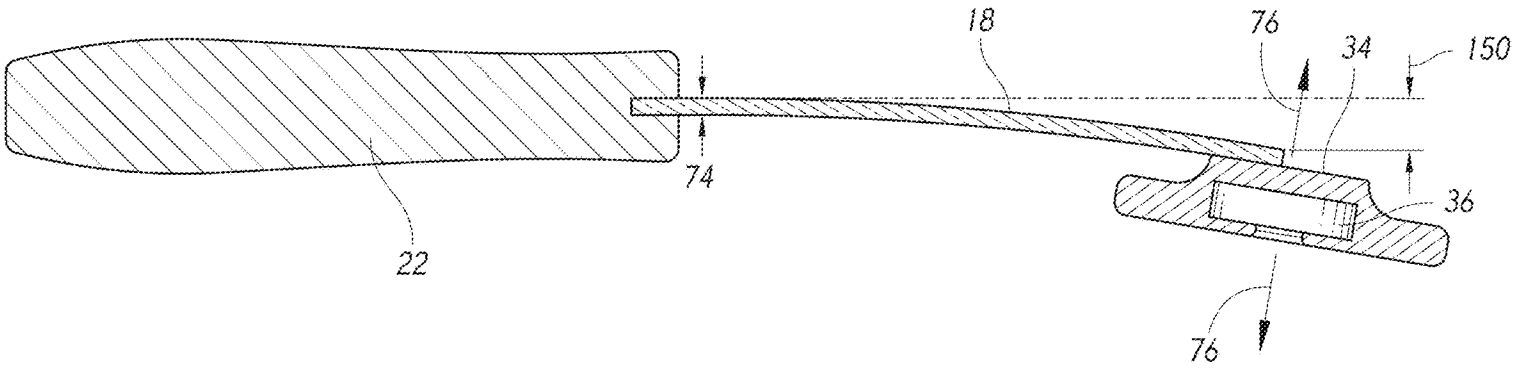
FIG. 12 is a cross-sectional view of the respiratory treatment device of FIG. 1 taken along the cut plane 6-6 of FIG. 5 wherein the weighted head is deflected downward while the handle is held in place horizontally.

As illustrated in FIG. 12, in some embodiments, the weight of the weighted head 34 can be sufficient such that, when the cup 26 is removed, when the handle 22 is oriented horizontally and fixed in place (e.g., the first and second ends 46, 50 of the handle 22 are fixed in place horizontally with respect to each other), and when the shaft 18 is oriented such that a width 54 of the shaft is oriented horizontally, the first end 38 of the shaft 18 flexes downward (e.g., toward the ground) by a distance 150 of at least ¼ inches. In some cases, the first end 38 of the shaft 18 flexes downward by a distance 150 of at least ⅜ inches. In some embodiments, when a 1 pound weight is added to the head 34, the first end 38 of the shaft 18 flexes downward by a distance 150 of at least 1 inch, at least 1¼ inches, at least 1½ inches, at least 2 inches, and/or at least 3 inches. In some cases, the first end 38 of the shaft 18 flexes downward by a distance 150 of approximately 2⅜ inches when a 1 pound weight is attached to the head 34. In some embodiments, the first end 38 of the shaft 18 flexes downward by a distance 150 of at least 2 inches, at least 2½ inches, at least 3 inches, at least 3½ inches, and/or at least 4 inches when a 2 pound weight is attached to the head 34. In some case the first end 38 of the shaft 18 flexes downward by a distance 150 of approximately 4½ inches when a 2 pound weight is attached to the head 34.

Increasing the weight of the head 34 can increase flexing and/or vibration in the shaft 18 of the device during treatment. Increasing flexing and/or vibration of the shaft 18 can increase the force of impact of the cup 26 upon a patient with respect to the force with which the clinician swings the device 10. In some embodiments, increasing the flexing in the shaft 18 can reduce stress in the wrist and/or arm of the clinician by reducing the input force necessary to impact the patient with a desired force. For example, the weighted head 34 can increase the flexing of the shaft 18 relative to the input force provided by the clinician or practitioner using the device 10, thereby amplifying the movements of the clinician or practitioner.

Figure 5:
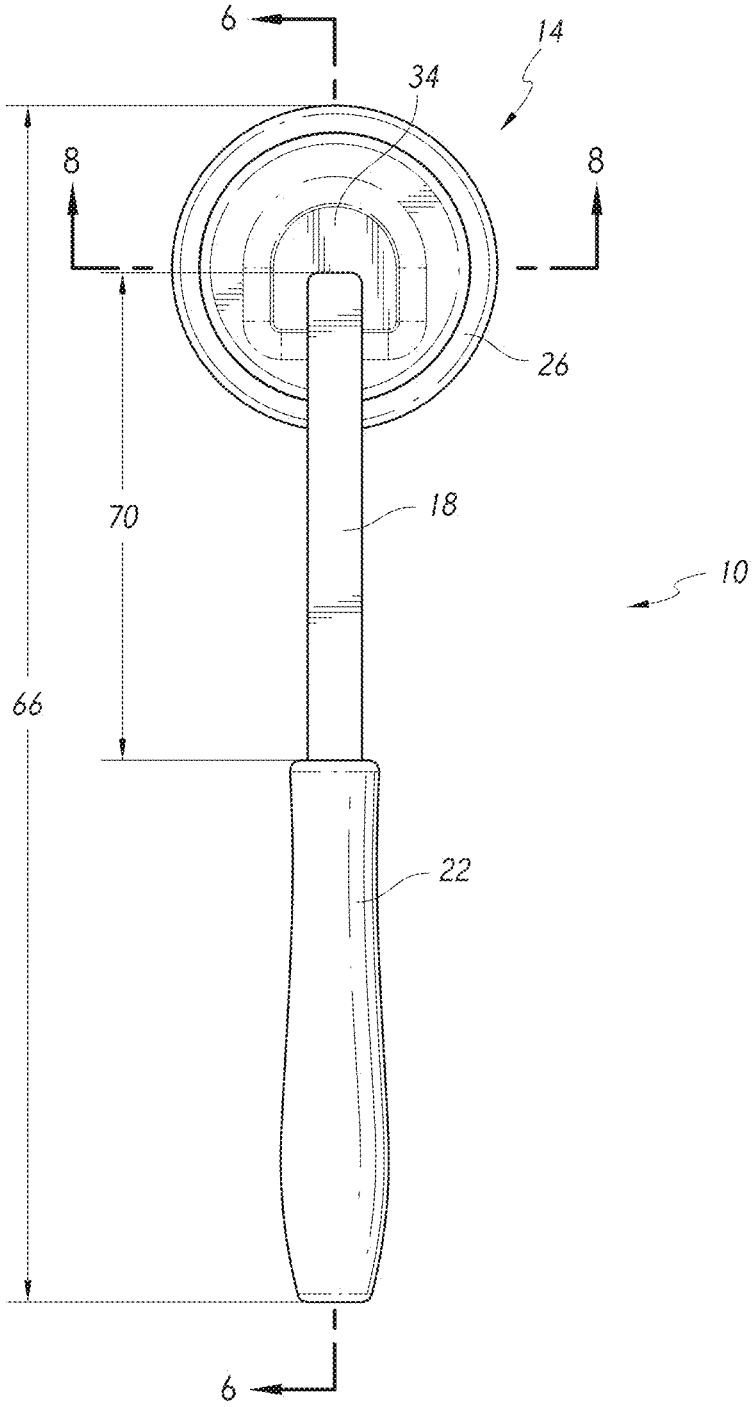
FIG. 5 is a rear elevational view of the respiratory treatment device of FIG. 1.

As illustrated in FIG. 5, a length 70 of the shaft 18 can be greater than about ⅛ of a length 66 of the device 10 and/or less than about 9/10 of the length 66 of the device 10. The shaft 18 can be approximately 4.5 inches in length. In some embodiments, the shaft 18 is greater than or less than 4.5 inches in length. In some cases, the shaft length 70 is greater than about ⅓ and/or less than about ⅗ of the length 66 of the device 10. In some embodiments, the shaft length 70 can be approximately ⅖ of the overall length 66 of the device 10. Many variations are possible. Increasing the length 70 of the shaft 18 with respect to the overall length 66 of the device 10 can move the inflection point of the shaft 18 (e.g., the point about which the shaft 18 has the greatest bending value during use of the device 10) further from the impact portion 14. In some embodiments, increasing the length 70 of the shaft 18 with respect to the overall length 66 of the device 10 can increase the overall flexibility of the device 10. The relationship between the length 70 of the shaft 18 and the overall length 66 of the device 10 can be optimized to provide desired flexing, vibration, and balance (e.g., center of gravity along the length 66 of the device 10). For example, the device 10 can be configured (e.g., via relative lengths and/or weights of the individual components) such that the center of gravity of the device 10 along the length 66 is approximately 1-2 inches toward the handle 22 from the head 34. Many variations are possible. In some embodiments, the overall weight of the device 10 is configured to be heavy (e.g., at least 4 ounces) to imitate the weight and/or force applied by the hand of a clinician during a chest physical therapy session.

Figure 4:
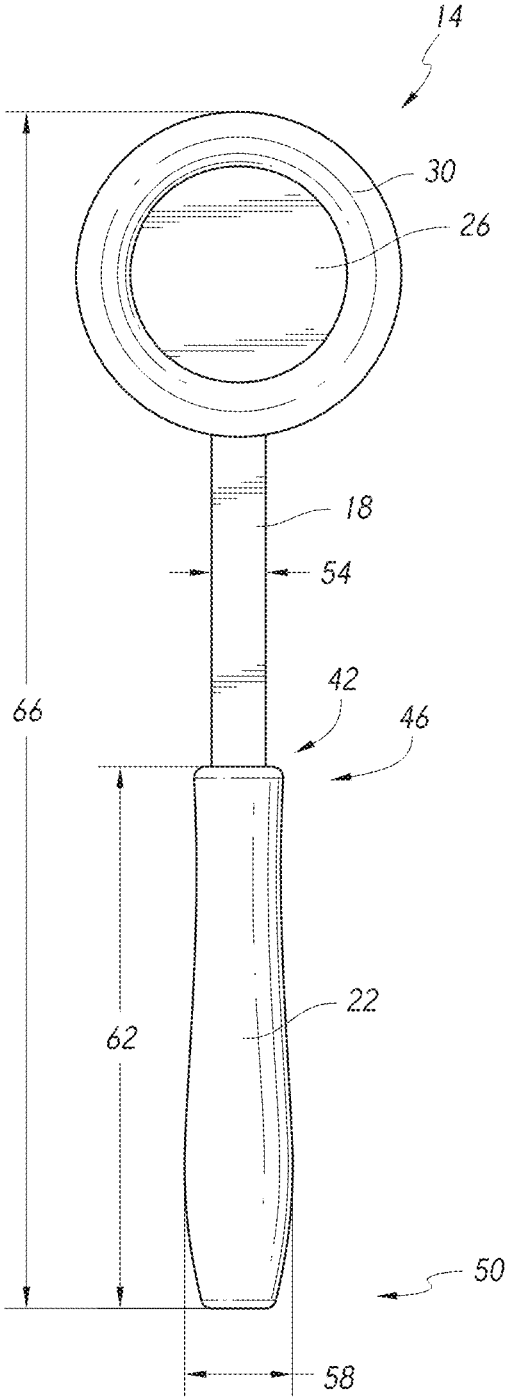
FIG. 4 is a front elevational view of the respiratory treatment device of FIG. 1.

As illustrated in FIG. 4, a second end 42 of the shaft 18 can be connected to a first end 46 of the handle 22. The handle 22 can be approximately 5 inches in length. In some embodiments, the handle 22 is greater than or less than 5 inches in length. In some embodiments, a length 62 of the handle 22 (FIG. 4), as measured between the first and second ends 46, 50 of the handle, can be greater than about 1/10 and/or less than about ⅗ of the overall length 66 of the respiratory treatment device 10. In some embodiments, the length 62 of the handle 22 is greater than about 3/10 and/or less than about ½ of the length of the device. In some embodiments, the length 62 of the handle 22 is approximately 45% of the length 66 of the device 10. Many variations are possible. Increasing the length 62 of the handle 22 with respect to the overall length 66 of the device 10 can move the inflection point of the shaft 18 (e.g., the point about which the shaft 18 has the greatest bending value during use of the device 10) closer to the impact portion 14. In some embodiments, increasing the length 62 of the handle 22 with respect to the overall length 66 of the device 10 can increase the overall stiffness of the device 10. The relationship between the length 62 of the handle 22 and the overall length 66 of the device 10 can be optimized to provide desired flexing, vibration, and balance. In some embodiments, a weight of the handle 22 can be adjusted via use of differing materials and/or via adjustment of the dimensions of the handle 22. In some cases, the handle 22 can have a weight of greater than 0.2 ounces, greater than 0.5 ounces, greater than 1 ounce, greater than 1.5 ounces, greater than 2.5 ounces, and/or greater than 4 ounces. Increasing the weight of the handle 22 can move the center of gravity of the device 10 toward the handle 22.

Figure 6:
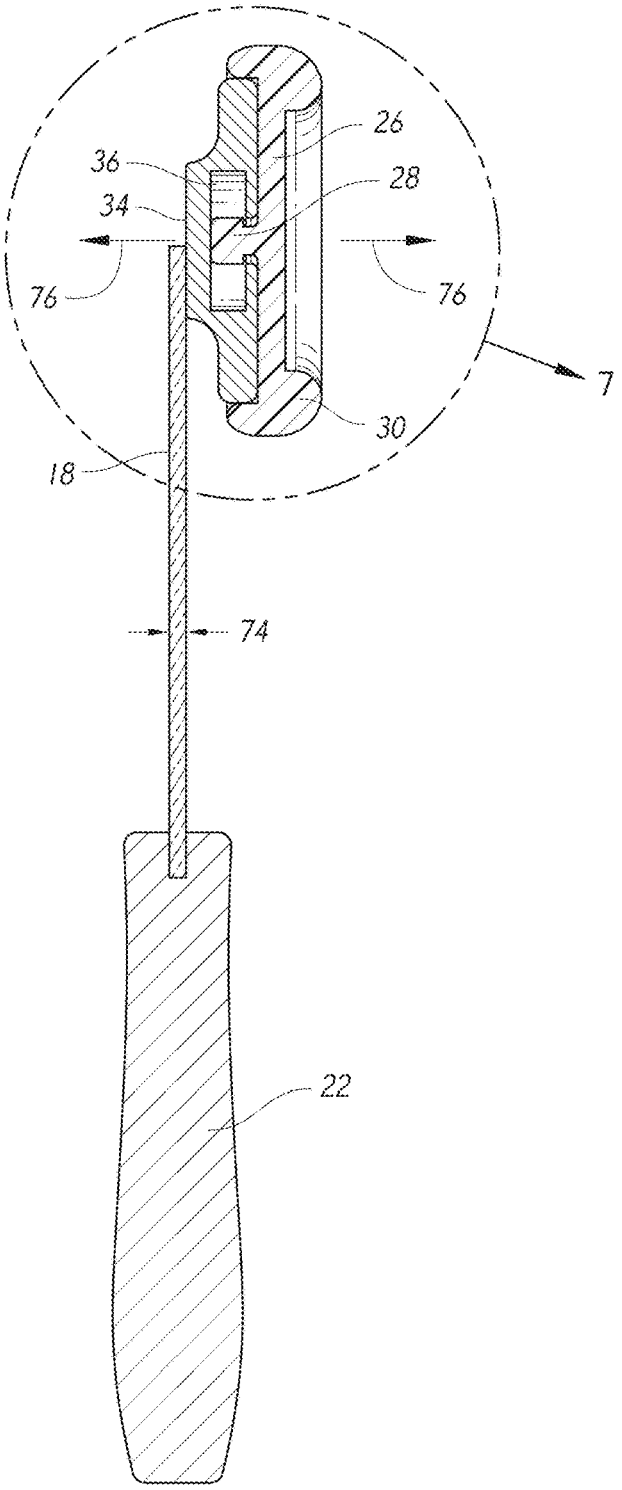
FIG. 6 is cross-sectional view of the respiratory treatment device of FIG. 1 taken along the cut plane 6-6 of FIG. 5.

As illustrated in FIGS. 4-6, the shaft 18 can have a shaft width 54 (e.g., a width as observed from the front face of the cup 26 of the assembled device 10). The shaft width 18 can be less than a width 58 of the handle 22 (e.g., a maximum width of the handle 22). In some cases, the shaft width 18 is approximately 0.5 inches. In some cases, the shaft width 18 is greater than or less than 0.5 inches. The handle width 58 can be approximately 0.75 inches. In some embodiments, the handle width 58 is less than or greater than 0.75 inches. In some embodiments, the shaft width 54 is greater than about ¼ and/or less than about ¾ of the handle width 58. In some embodiments, the shaft width 54 is greater than about 4/10 and/or less than about 6/10 of the handle width 58. In some cases, the shaft width 54 is approximately ½ the handle width 58. Many variations are possible. Increasing the shaft width 54 with respect to the lengths 62, 66, 70 of the handle 22, overall device 10, and shaft 18 can move the center of gravity of the overall device 10 away from the head 34 and toward the handle 22. Moving the center of gravity of the device 10 toward the handle 22 can reduce stress (e.g., in the wrists and arms) on a clinician or other practitioner during use of the device 10. For example, moving the center of gravity toward the handle 22 can reduce the force required to move the impact portion 14 of the device.

As illustrated in FIG. 6, the shaft 18 can have a shaft thickness 74 (e.g., a thickness of the shaft 18 as measured perpendicular to both shaft width 54 and shaft length 70). In some cases, the shaft thickness 74 is approximately 0.125 inches. In some cases, the shaft thickness 74 is greater than or less than 0.125 inches. In some embodiments, the shaft thickness 74 is less than the shaft width 54. For example, the shaft thickness 74 can be greater than about 1/10 of the shaft width 54 and/or less than ½ the shaft width 54. In some embodiments, the shaft thickness 74 is greater than about ¼ and/or less than about ⅜ of the shaft width 54. As illustrated, the shaft thickness 74 can be approximately ⅓ the shaft width 54. Many variations are possible. Reducing the shaft thickness 74 can increase the flexibility of the shaft 18 and/or can move the center of gravity of the device toward the head 34. Increasing the shaft thickness 74 can move the center of gravity toward the handle.

In some embodiments, as illustrated, the shaft 18 can have a constant or semi-constant (e.g., within 10%) cross-sectional area between the first end and the second end of the shaft 18. Maintaining a constant or semi-constant cross-section and reduce manufacturing costs. In some embodiments, the shaft 18 is constructed from a metal such as steel (e.g., 1095 Steel).

Figure 7:
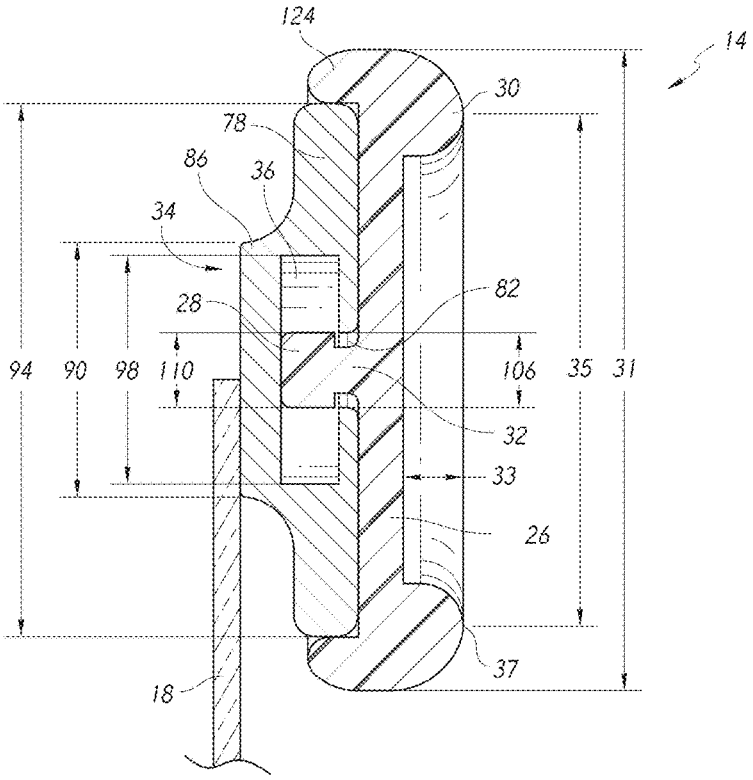
FIG. 7 is a zoomed in cross-sectional view of the respiratory treatment device of FIG. 1 taken along the cut plane 6-6 of FIG. 5.

As illustrated in FIG. 7, the head 34 can include a front portion 78. The front portion 78 can include a recess opening 82 facilitating access to the recess 36 within the head 34. In some embodiments, the head 34 includes a back portion 86. The back portion 86 can be connected to the shaft 18. In some embodiments, the back portion 86 is smaller than the front portion 78. For example, the back portion 86 can have a smaller perimeter than a perimeter of the front portion 78, as observed from a perspective normal to a front face of the head 34.

Figure 8:
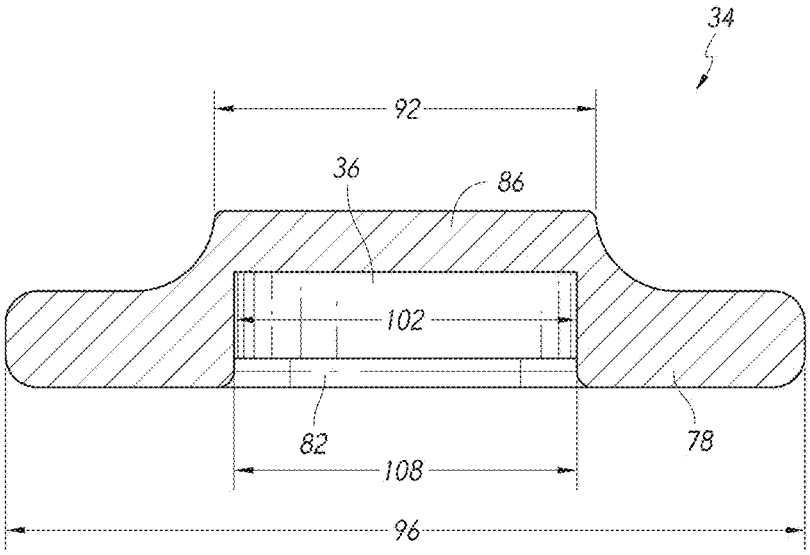
FIG. 8 is a cross-sectional view of a head of the respiratory treatment device of FIG. 1 taken along the cut plane 8-8 of FIG. 5.

In some embodiments, a height 90 of the back portion 86 is less than about ⅘ and/or greater than about 1/10 of a height 94 of the front portion 78. In some embodiments, the height 90 of the back portion 86 is less than about ⅗ and/or greater than about ⅖ of the height 94 of the front portion 78. As illustrated, the height 90 of the back portion 86 can be 9/20 of the height 94 of the front portion 78. The width 92 of the back portion 86 can have the same or a similar proportional relationship with the width 96 of the front portion 78 as described above with respect to the heights 90, 94 of the back and front portions 86, 78, as illustrated in FIG. 8. Many variations are possible. In some embodiments, the front portion 78 and/or the back portion 86 have generally circular or disc shapes, and the heights and widths 90, 92, 94, 96 are equivalent to the diameters of the front and back portions 78, 86.

As illustrated in FIGS. 5 and 7, the height/diameter 94 of the front portion 78 is greater than about ½ and less than about 19/20 of the height/diameter 31 of the cup 26. In some embodiments, the diameter 94 of the front portion 78 is greater than about ⅝ and less than about 9/10 of the diameter 31 of the cup 26. In some embodiments, the diameter 94 of the front portion 78 is greater than about ¾ and less than about 17/20 of the diameter 31 of the cup 26. In some cases, the diameter 94 of the front portion 78 is approximately ⅘ of the diameter 31 of the cup 26. Many variations are possible. In some embodiments, as illustrated in FIG. 7, the diameter 94 of the front portion 78 is approximately equal to (e.g., within 10%) of a diameter 35 of a contact portion 37 of the raised perimeter 30 of the cup 26 (e.g., the portion of the raised perimeter 30 that first contacts a patient during use of the device 10). In some embodiments, the diameter 94 of the front portion 78 is less than or greater than the diameter 35 of the contact portion 37 of the raised perimeter 30.

In some embodiments, increasing the perimeter and/or the cross-sectional area (e.g., as measured parallel to the front face of the head 34) of the front portion 78 of the weighted head 34 with respect to the perimeter of the cup 26 can reduce the likelihood that any edges of the head 34 are impacted upon the patient directly during use of the device 10. In some embodiments, increasing the perimeter and/or the cross-sectional area of the front portion 78 of the weighted head 34 with respect to the perimeter of the cup 26 can reduce the likelihood that any edges of the head 34 are impacted upon the patient indirectly during use of the device 10. For example, positioning the perimeter of the front portion 78 of the head 34 nearer the raised perimeter 30 of the cup 26 can distribute the force of the head 34 over a large area and can reduce the risk that the cup 26 collapses during use of the device 10. Reducing the risk of collapse of the cup 26 can reduce the risk that the head 34 impacts the patient indirectly through a collapsed portion of the cup 26 (e.g., through a portion of the cup 26 other than the raised perimeter 30).

In some embodiments, having a weighted head 34 with a front portion 78 having a large perimeter can facilitate use of a cup 26 having a reduced depth (e.g., thickness measured normal to a front face of the cup 26) while avoiding impact of the weighted head 34 directly or indirectly on the patient. Reducing the depth of the cup 26 can reduce material, manufacturing, and/or shipping costs for the device 10. In some embodiments, reducing the depth of the cup 26 can reduce the storage capacity required to maintain an adequate inventory of cups 26. In some cases, it may be desirable to utilize a cup 26 having a large perimeter/diameter and a shallow depth. Utilizing a weighted head 34 having a front portion 78 with a large perimeter (e.g., a perimeter similar to the perimeter of the cup) can facilitate use of such cups 26 having larger perimeters and shallow depths.

Referring to FIGS. 7 and 8, the recess 36 can have a height 98. The recess 36 can have a width 102. In some embodiments, the recess width 102 is less than or equal to the recess height 98. In some embodiments, the recess width 102 is greater than the recess height. In some cases, the recess 36 has a circular or disc shape with a constant diameter (e.g., wherein the recess width 102 is equal to the recess height 98). Many variations are possible.

Figure 9:
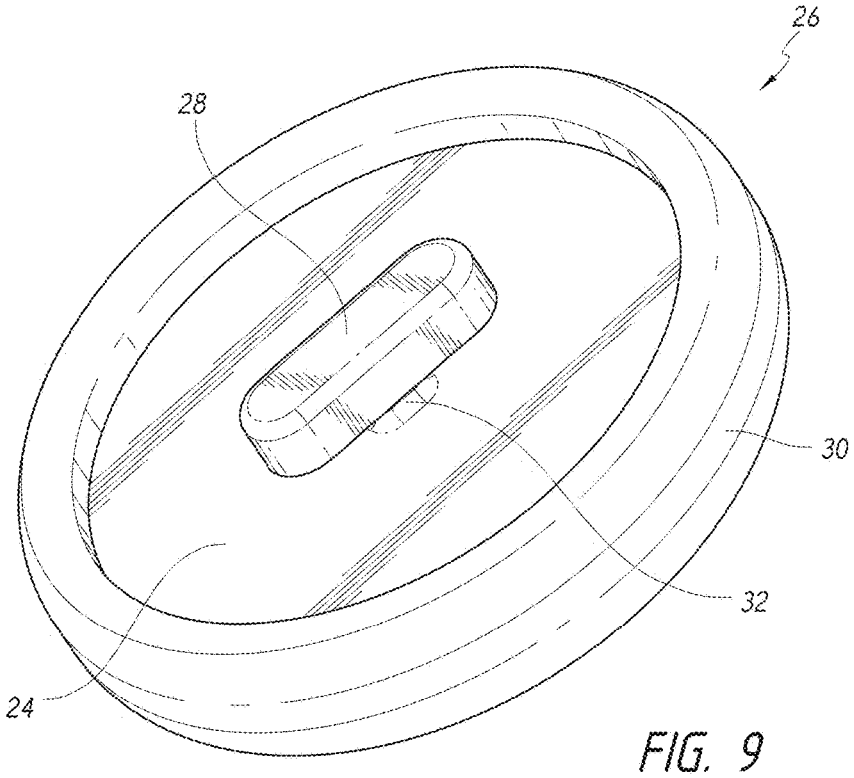
FIG. 9 is a rear perspective view of an embodiment of a cup.
Figure 10:
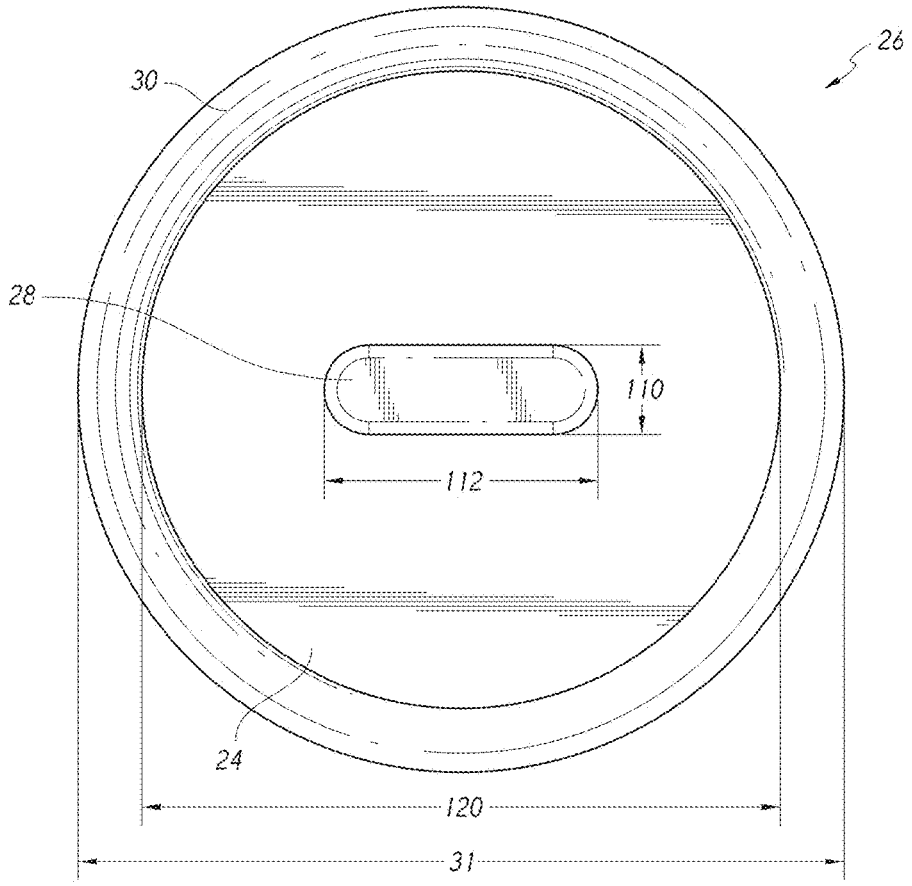
FIG. 10 is a rear elevational view of the cup of FIG. 9.
Figure 11:
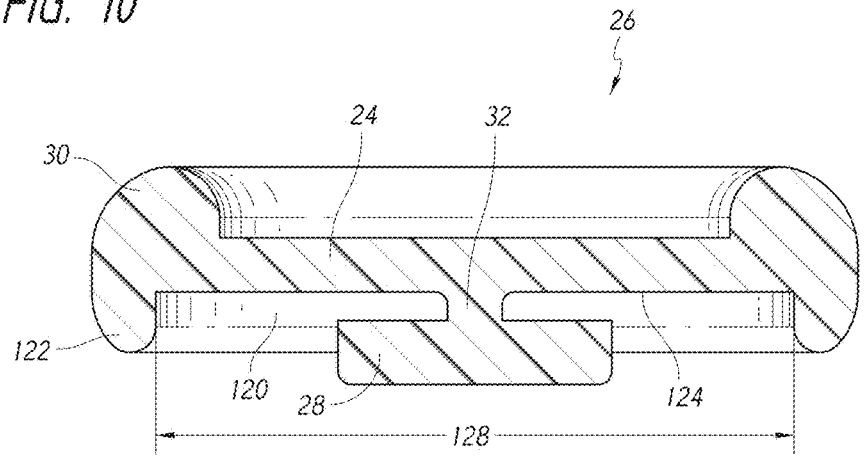
FIG. 11 is a cross-sectional view of the cup of FIG. 9 taken along the cut plane 8-8 of FIG. 5.

As illustrated in FIGS. 9-11, the protrusion 28 can have an elongate shape wherein a width 112 of the protrusion 28 is greater than a height 110 of the protrusion 28. The protrusion 28 can include a neck portion 32 which is smaller in width 116 and/or height than the remainder of the protrusion 28. The neck portion 32 can be positioned between a back end (e.g., an end furthest from the front face of the cup 26) of the protrusion 28 and the center portion 24 of the cup 26.

Figure 7A:
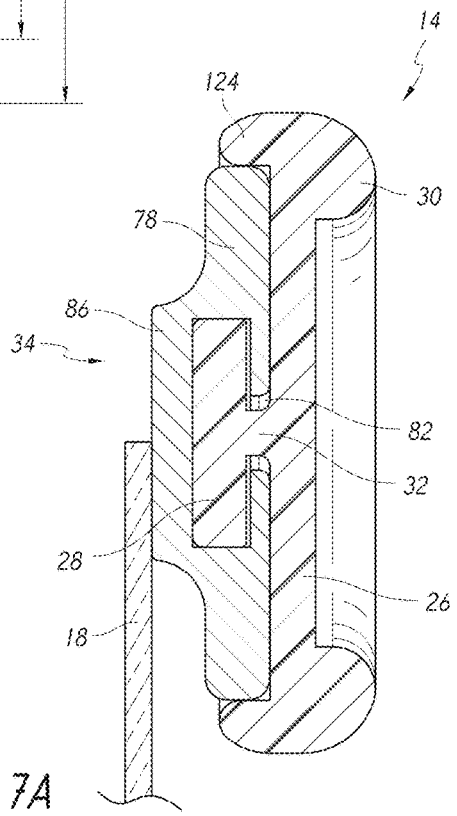
FIG. 7A is a zoomed in cross-sectional view of the respiratory treatment device of FIG. 1 taken along the cut plane 6-6 of FIG. 5, wherein the cup is rotated 90° with respect to the head.

As illustrated in FIGS. 1 and 7A, the recess opening 82 can be sized and shaped to permit at least a portion of the protrusion 28 to pass there through. For example, the recess opening 82 can have a height 106 greater than a height 110 of the protrusion 28 and a width 102 greater than a width 112 of the protrusion 28. As illustrated, the height 106 of the recess opening 82 can be smaller than the width 112 of the protrusion 28. In some embodiments, the neck portion 32 of the protrusion 28 is positioned such that the neck portion 32 aligns with the recess opening 82 in a direction normal to the front face of the cup 26 and/or normal to the front face of the head 34.

The recess 36 and recess opening 82 can be sized and shaped to permit rotation of at least a portion of the protrusion 28 within the recess 36. For example, a minimum width of the recess 36 (e.g., a distance between two opposite sides of the recess 36) can be greater than a maximum width of the protrusion 28. In some embodiments, a minimum width of the recess opening 82 is greater than a maximum width of a neck portion 32 of the protrusion 28. Sizing the opening 82 such that the minimum width of the recess opening 82 is greater than the maximum width of a neck portion 32 of the protrusion 28 can permit the neck portion 32 to rotate (e.g., about an axis of rotation normal to the front face of the head 34) within the opening 82. The neck portion 32 can be constructed from a flexible and/or resilient material, thereby permitting the neck portion 32 to have a greater maximum width than the minimum width of the recess opening 82. For example, the neck portion 32, or some portion thereof, can deflect in reaction to contact with the recess opening 82 during rotation of the protrusion 28 within the recess 36.

A maximum width of the protrusion 28 can be greater than a minimum width of the opening 82 (e.g., the height of the opening 82, as illustrated in FIG. 7). In some such embodiments, interference between the protrusion 28 and the inner walls of the recess 36 (see FIG. 7A) can inhibit or prevent accidental removal of the cup 26 from the head 34 when the protrusion 28 is rotated within the recess 36 (e.g., rotated away from the orientation in which the protrusion 28 is aligned to fit through the opening 82).

As illustrated in FIGS. 7 and 11, the height 94 (e.g., diameter) of the front portion 78 of the head 34 can be sized to fit within a rear recess 120 of the cup 26. The rear recess can be at least partially bound by a rear rim 122 extending back (e.g., away from the rim 30) from a rear face 124 of the cup 26. The rear recess 120 can have a perimeter sized and shaped substantially the same as a perimeter of the front portion 78 of the head 34. For example, the front portion 78 of the head 34 and the rear recess 120 can both be circular and can have diameters 94, 128 that are substantially equal (e.g., within ±10%). In some embodiments, the diameters 94, 128 are approximately 2 inches. In some embodiments, the diameters 94, 128 are approximately 2.75 inches. In some cases, the diameters 94, 128 are greater than about 2 inches and/or less than about 2.75 inches. A tight fit between the outer perimeter of the front portion 78 of the head 34 and the rear rim 122 can increase stability of the cup 26 with respect to the head 34. For example, the tight fit between the head 34 and the cup 26 can reduce or eliminate lateral movement (e.g., movement in the plane of the front face of the head 34) of the cup 26 with respect to the head 34 when the cup 26 is coupled with the head 34.

The rim 30 can have a diameter 31 (FIG. 7) that is large enough to facilitate cupping on the surface of a patient (e.g., chest, back) when a clinician impacts the cup 26 upon a patient. The diameter 31 of the rim 30 can be small enough to reduce the likelihood that the patient is impacted by the center portion 24 or any other non-cushioned portion of the cup 26. For example, the diameter 31 of the rim 30 can be between 2 inches and 5 inches. In some embodiments, the diameter 31 is greater than 1.5 inches and/or less than about 6 inches. In some applications (e.g., for adults), the diameter 31 of the rim 30 is approximately 3 inches. In some applications (e.g., for children and/or infants), the diameter of the rim 30 is approximately 2.25 inches. Many variations are possible. A depth 33 of the rim 30 (e.g., the distance the rim 30 extends from the center portion 24 of the cup 26) can be between 0.25 inches and 4 inches. In some embodiments, the depth 33 of the rim 30 is greater than about 0.5 inches and/or less than about 3 inches. In some applications (e.g., for adults), the depth 33 of the rim 30 is approximately 1 inch, and in some other application (e.g., for children and infants), the depth 33 of the rim 30 is approximately 0.625 inches. Increasing the depth 33 of the rim 30 can increase the cupping (e.g., the volume defined by the center portion 24, the rim 30, and the surface against which the cup 26 is impacted) of the cup 26 during treatment. Limiting the depth 33 of the rim 30 can increase the structural stability of the rim 30 and inhibit or prevent folding and/or buckling of the rim 30 during treatment.

A method of using the device 10 can include choosing an appropriately-sized device 10 for a given patient. For example, a smaller device 10 can be used for an infant or small child than would be appropriate for an adult. The clinician can attach a removable cup 26 to the head 34 of the device 10 by inserting the protrusion 28 of the cup 26 through the recess opening 82 and then rotating the cup 26 about an axis of rotation normal to a front surface of the head 34. The clinician can perform chest physical therapy by impacting the cup 26 against the chest and/or back of the patient. In some cases, the clinician vibrates the cup 26 against the chest and/or back of the patient. For example, the clinician can rapidly rotate the device 10 about the length 66 to produce small, rapid impacts between the rim 30 of the cup 26 and the chest/back of the patient.

Upon completion of treatment of a first patient, the clinician can remove the cup 26 from the head 34 of the device 10 by rotating the cup 26 such that the protrusion 28 fits through the recess opening 82 for removal. The cup 26 can be discarded (e.g., destroyed, thrown away, or otherwise discarded), and the remainder of the device 10 can be sterilized using any appropriate method of sterilization. The clinician can attach a second cup 26 to the head 34 of the device in the same manner described above. The clinician can then treat a second patient using the same or similar techniques as those described above with respect to the first patient.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. Additionally, the skilled artisan will recognize that any of the above-described methods can be carried out using any appropriate apparatus. Further, the disclosure herein of any particular feature, aspect, method, property, characteristic, quality, attribute, element, or the like in connection with an embodiment can be used in all other embodiments set forth herein. For all of the embodiments described herein, the steps of the methods need not be performed sequentially. Thus, it is intended that the scope of the present inventions herein disclosed should not be limited by the particular disclosed embodiments described above.

What is claimed is:

1. A respiratory cupping device comprising:

a shaft having a first end, a second end, a shaft length extending between the first end and the second end, a shaft width measured normal to the shaft length, and a shaft thickness measured perpendicular to the width and normal to the shaft length;

a handle having a first end, a second end, a handle length extending between the first end and the second end of the handle, and a handle width measured normal to the handle length, the second end of the handle connected to the second end of the shaft;

a weighted head having a front face and connected to the first end of the shaft; and a cup removably connected to the weighted head and having a back side facing the front face of the weighted head and a front side facing away from the weighted head, the front side having a raised perimeter surrounding a central portion of the cup, the raised perimeter extending further away from the weighted head than the central portion;

wherein a portion of the weighted head is configured to fit within a recess on the back side of the cup, wherein the weighted head includes a back portion having a first width and height parallel to the front face, and a front portion having a second width and height parallel to the front face, wherein the second width is greater than the first width and the second height is greater than the first height;

wherein the raised perimeter of the cup had a third width and height, and wherein the second width is greater than three fourths of the third width and the second height is greater than three fourths of the third height; and wherein the cup includes a keyed protrusion extending from the back side of the cup, and wherein the weighted head includes a keyed recess sized and shaped to couple with the keyed protrusion to releasably couple the cup to the weighted head.

2. The respiratory cupping device of claim 1, wherein the shaft is constructed from a metal.

3. The respiratory cupping device of claim 1, wherein the raised perimeter is constructed from a foam.

4. The respiratory cupping device of claim 1, wherein the weighted head weighs at least 1.5 ounces.

5. The respiratory cupping device of claim 1, wherein the shaft width is constant from the first end of the shaft to the second end of the shaft.

6. The respiratory cupping device of claim 1, wherein the shaft thickness is constant from the first end of the shaft to the second end of the shaft.

7. The respiratory cupping device of claim 1, wherein the keyed protrusion comprises a protrusion height and a protrusion width parallel to the back side of the cup, the protrusion width being greater than the protrusion height.

8. The respiratory cupping device of claim 7, wherein the keyed recess comprises a height and a width, the height of the opening being greater than the protrusion height and the width of the opening being greater than the protrusion width, and wherein the keyed recess is configured to receive the keyed protrusion therein.

9. The respiratory cupping device of claim 8, wherein the keyed recess has a perimeter greater than a perimeter of the opening of the recess, and wherein the perimeter of the opening of the recess interferes with movement of the cup away from the weighted head after the keyed protrusion is inserted into the keyed recess and rotated about an axis of rotation normal to the back side of the cup.

10. The respiratory cupping device of claim 1, wherein the handle and the shaft form a monolithic part.

11. The respiratory cupping device of claim 1, wherein the handle is constructed from a polymer.

12. The respiratory cupping device of claim 1, wherein the handle width is at least five times greater than the thickness of the shaft and at least 1.5 times greater than the shaft width.

13. A method of performing chest physical therapy, the method comprising:

obtaining a respiratory therapy device having:

a handle;

a shaft connected to and extending from the handle;

a weighted head connected to an end of the shaft opposite an end of the shaft connected to the handle; and a removable cup having a backside coupled to the weighted head, the removable cup having a center portion and a raised cushioned perimeter surrounding the center portion;

wherein a portion of the weighted head is configured to fit within a recess on the back side of the cup, wherein the weighted head includes a back portion having a first width and height parallel to the front face, and a front portion having a second width and height parallel to the front face;

wherein the raised cushion perimeter of the cup has a third width and height, and wherein the second width is greater than three fourths of the third width and the second height is greater than three fourths of the third height; and wherein the cup includes a keyed protrusion extending from the back side of the cup, and wherein the weighted head includes a keyed recess sized and shaped to couple with the keyed protrusion to releasably couple the cup to the weighted head;

impacting a first patient with the cushioned perimeter;

removing the removable cup from the weighted head;

sterilizing the handle, shaft, and weighted head;

coupling a second removable cup to the weighted head; and impacting a second patient with a cushioned perimeter of the second removable cup.

14. A chest physical therapy device comprising:

a handle having a first end and a second end;

a shaft having a width, a thickness, a first end, and a second end connected to the first end of the handle;

a weighted head connected to the first end of the shaft; and a removable cup having a convex side removably connected to the weighted head and a concave side facing away from the weighted head and having a raised perimeter;

wherein the first end of the shaft flexes downward at least ¼ inches when the handle is fixed horizontally, the width of the shaft is oriented horizontally, and the removable cup is removed from the weighted head; and wherein a portion of the weighted head is configured to fit within a recess on the convex side of the cup, wherein the weighted head includes a back portion having a first width and the height parallel to the front face, and a front portion having a second width and height parallel to the front face;

wherein the raised perimeter of the cup has a third width and height, and wherein the second width is greater than three fourths of the third width and the second height is greater than three fourths of the third height; and wherein the cup includes a keyed protrusion extending from the convex side of the cup, and wherein the weighted head includes a keyed recess sized and shaped to couple with the keyed protrusion to releasably couple the cup to the weighted head.

15. The device of claim 14, wherein the first end of the shaft flexes downward approximately ⅜ inches when the handle is fixed horizontally and the width of the shaft is oriented horizontally.

16. The device of claim 14, whereby the first end of the shaft flexes downward approximately 3.5 inches when the handle is fixed horizontally the width of the shaft is oriented horizontally, and the removable cup is removed from the weighted head, and a one pound weight is attached to the weighted head.

17. The device of claim 14, whereby the first end of the shaft flexes downward approximately 4.5 inches when the handle is fixed horizontally, the width of the shaft is oriented horizontally, and the removable cup is removed from the weighted head, and a two pound weight is attached to the weighted head.

* * * * *